United States Patent [19]

DiFerdinando

[11] 4,066,384

[45] Jan. 3, 1978

[54] TURBINE ROTOR BLADE HAVING INTEGRAL TENON THEREON AND SPLIT SHROUD RING ASSOCIATED THEREWITH

[75] Inventor: Frank L. DiFerdinando, West Chester, Pa.

[73] Assignee: Westinghouse Electric Corporation, Pittsburgh, Pa.

[21] Appl. No.: 596,937

[22] Filed: July 18, 1975

[51] Int. Cl.[2] ..... F01D 5/22

[52] U.S. Cl. ..... 416/189; 416/191; 416/195

[58] Field of Search ..... 416/189, 195, 191, 192, 416/213 R

[56] References Cited

U.S. PATENT DOCUMENTS

| | | | |
|---|---|---|---|
| 910,311 | 1/1909 | Pratt | 416/189 |
| 1,010,750 | 12/1911 | Green | 416/192 |
| 1,152,812 | 9/1915 | Hanzlik | 416/189 |
| 2,221,684 | 11/1940 | Smith | 416/191 |
| 2,278,041 | 3/1942 | Allen | 416/191 |
| 2,315,616 | 4/1943 | Hall | 416/217 |
| 2,345,918 | /1944 | Dahlstrand | 29/156.8 |
| 2,350,125 | 5/1944 | Dahlstrand | 416/192 |
| 3,367,630 | 2/1968 | Saunders | 416/195 |

FOREIGN PATENT DOCUMENTS

| | | | |
|---|---|---|---|
| 311,163 | 2/1919 | Germany | 416/189 |

*Primary Examiner*—Everette A. Powell, Jr.
*Attorney, Agent, or Firm*—J. W. Keen

[57] ABSTRACT

A rotor for a turbine apparatus and method for fabricating the same. The rotor has a plurality of rotating blades mounted thereon subtended by a substantially annular shroud member. The shroud member is comprised of two axial segments joined along a circumferential seam. The segments have openings on their adjoining edges which are sized to accept a stem portion of a tenon integrally disposed on the radially outward tip of each rotating blade. The tenon stem has integral therewith a bulbous cap portion which, in the assembled state, simultaneously overlap circumferentially and axially the adjoined shroud segments. A circumferential groove is defined between the shroud segments and a suitable securing arrangement is provided in the groove to maintain the relationship between the axial shroud segments.

7 Claims, 5 Drawing Figures

TURBINE ROTOR BLADE HAVING INTEGRAL TENON THEREON AND SPLIT SHROUD RING ASSOCIATED THEREWITH

BACKGROUND OF THE INVENTION

1. Field of the Invention

This invention relates to rotors for axial flow turbine apparatus, and in particular, to a rotor with blades having an integral tenon thereon and associated with split shroud segmented rings.

2. Description of the Prior Art

In general, an axial flow turbine apparatus comprises a casing member which confines and guides a motive fluid, commonly steam, through alternating arrays of rotating and stationary blades disposed therewithin to convert the high temperature, high pressure energy of the steam into rotational mechanical energy. The rotating blades, as is known to those skilled in the art, are mounted upon a rotor member and define a generally annular array of blades extending radially outward from the rotor. Each blade comprises an elongated airfoil portion secured to the rotor by a root portion integral therewith and terminating at its radially outward extremity in a blade tip.

It has been the practice in the art to group together a predetermined number of rotating blades within each annular array by the agency of a generally annular segmented shroud member. This has been accomplished in the prior art by providing at the tip of each rotating blade a radially outwardly projecting tenon. The shroud, generally an arcuate shaped member, has a circumferential array of openings disposed therein which are sized to receive the tenon from each of the predetermined number of rotating blades to be subtended by the shroud segment.

It has been the practice to radially engage the tenons at the extreme tip of each rotating blade with the openings in the shroud. Once engagement therebetween has been established, the prior art method of fabricating axial flow turbine rotors requires that the shroud be secured to the subtended blades by riveting or otherwise deforming the projecting tenons so as to axially and circumferentially overlap the associated shroud member. However, riveting or other prior art practices which secure the shroud to the tenons have the disadvantage in that such activity deleteriously effects the material strength properties of the tenons. Thus, as may be readily appreciated, the repeated hammering necessary in the prior art to secure a rivet into the tenon to circumferentially and axially link the shroud to the blade seriously effects and weakens the strength of the rotor fabricated thereby.

It is apparent that a rotor member which provides a secure arrangement for maintaining the shroud with its subtended blade group without the necessity of riveting or other deleterious attachment procedures is an advantageous and worthwhile improvement in the turbine art.

SUMMARY OF THE INVENTION

This invention discloses a turbine rotor and a method for fabricating same which overcomes the above discussed disadvantages of the prior art.

The rotor comprises a plurality of rotating blades, each blade having an integral and radially outwardly extending tenon member mounted thereon. Each tenon member is itself comprised of a stem portion and an integral bulbous cap portion. Associated with the rotating blades is a substantially annular shroud member which subtends a predetermined plurality of the rotating blades mounted on the rotor. The shroud comprises a first and a second axial segment which adjoin circumferentially in the final assembled relationship. Each segment has openings on the adjoining edges thereof sized to receive the stem portion of each of the tenons. When assembled, the bulbous cap portion simultaneously circumferentially and axially overlaps the adjoined shroud segments to radially secure them to the rotating blades.

An inclined surface on the adjoined edges of the shroud segments cooperate to define a circumferentially extending groove therebetween. A suitable securing arrangement, such as a weld, is disposed in the groove to axially secure the shroud segments to each other.

It is an object of this invention to provide a rotor for a turbine apparatus and a method for fabricating the same wherein an integrally mounted tenon member having a bulbous cap portion circumferentially and axially overlaps adjoined segments of a shroud to radially secure the shroud to the rotating blades. Further, it is an object to provide a circumferential groove defined by the adjoined shroud segments and to dispose in that groove a securing arrangement to maintain axial association of the shroud segments. Other objects of the invention will become clear in the detailed description of the preferred embodiment which follows herein.

BRIEF DESCRIPTION OF THE DRAWINGS

The invention will be more fully understood for the following detailed description of a preferred embodiment taken in connection with the accompanying drawings, in which.

DESCRIPTION OF THE PREFERRED EMBODIMENT

Figure 1:
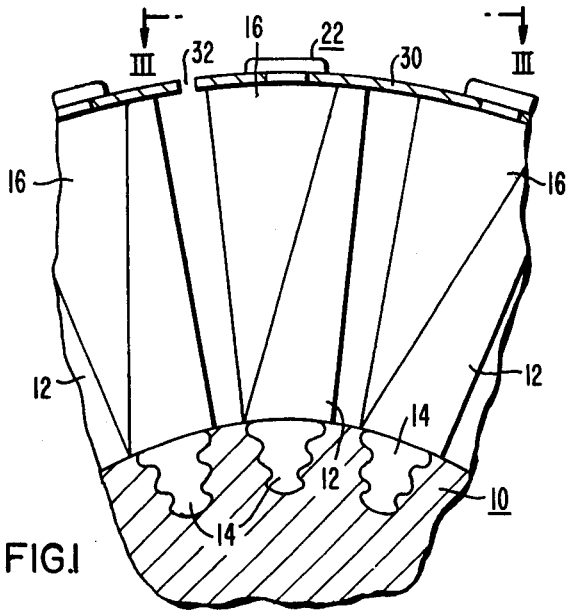
FIG. 1 is an elevation view showing a portion of a bladed rotor having a tenon and a shroud embodying the teachings of this invention.

Throughout the following description of the preferred embodiment, similar reference numerals refer to similar elements in all figures of the drawings.

Figure 2:
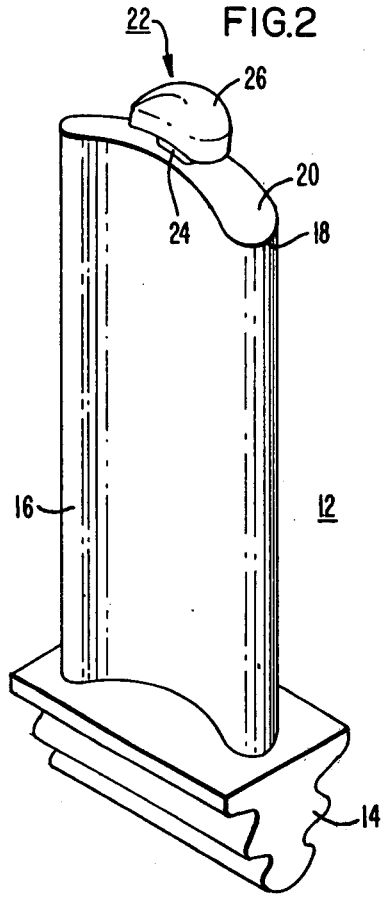
FIG. 2 is a perspective view of an individually rotating blade showing the integrally disposed tenon member embodying the teachings of this invention disposed thereon.

Referring now to FIGS. 1 and 2, a rotor member generally indicated by reference numeral 10, a portion of which is shown in FIG. 1, has disposed thereon a plurality of radially extending rotating blades 12, such as is illustrated in detail in FIG. 2. Each rotating blade 12 is affixed to the rotor 10 by a root portion 14. Extending radially outward from the root 14 is a curved airfoil 16 terminating in a blade tip 18. The blade tip 18 defines an inclined radial surface 20 thereon. As seen in FIG. 2, extending radially outward from the inclined radial surface 20 of the blade tip 18 is a tenon member generally indicated by reference numeral 22. The tenon comprises a stem portion 24 and a bulbous cap portion 26, the circumferential cross section of which is greater than the circumferential cross section of the stem 24. The outer perimeter of the stem 24 and the cap 26 may be of any desired configuration and is shown in the figures as being a parallelopiped, although any suitable configuration may be utilized. The tenon 22 is integrally disposed with the airfoil portion 16 of the blade 12 and may be provided at the radially outward tip 18 by a suitable machining process. In the prior art, a typical tenon comprises merely a stem portion and does not provide an integrally enlarged bulbous cap portion that characterizes the teachings of this invention.

The purpose of the tenon 22 is to engage and provide radial attachment for a generally arcuate-shaped shroud member, indicated in the drawings by reference numeral 30. The shroud 30 subtends a group of rotating blades 12 to assist in control of vibration engendered in the blades 12 during operation of the rotor 10. As seen from FIG. 1, shroud 30 subtends a group of blades, it being understood that any predetermined number of rotating blades 12 disposed in the annular array of blades mounted on the rotor 10 may be subtended by the shroud 30. Between these circumferential termini of adjacent shrouds 30 is a circumferential gap 32.

In the prior art, the shroud is provided therein with a circumferential array of openings disposed so as to register with the stem-like tenons provided on the radially outward tips of the rotating blades. It has been the practice in the art to engage the openings in the shroud with the stem-like tenons provided on prior art blades. Once this has been accomplished, riveting or other suitable attachment means are provided to radially secure the shroud to the subtended blade group. However, as discussed above, such riveting has a deleterious effect of disrupting the material strength of the blades, and for this reason, proved disadvantageous.

Figure 3:
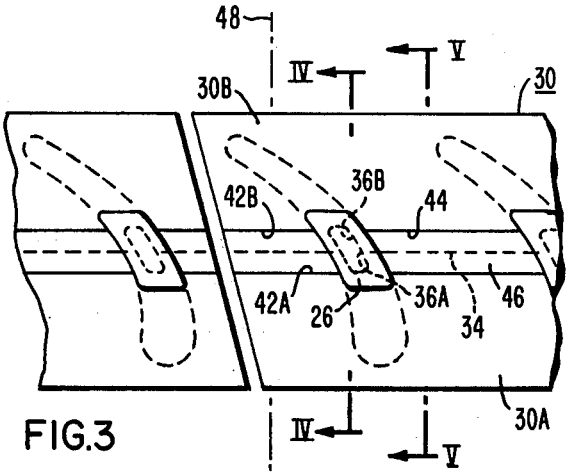
FIG. 3 is a view taken along lines III—III in FIG. 1.
Figure 5:
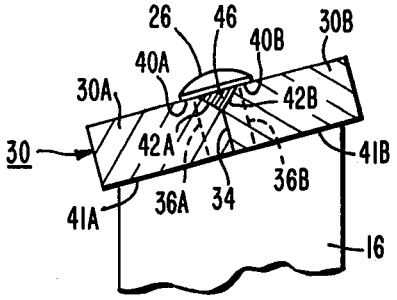
Figure 4:
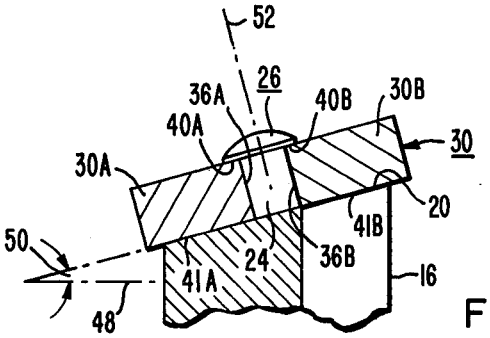
FIG. 4 is an elevational view taken along lines IV—IV of FIG. 3, and rotated 90° with respect to the view shown therein; and, FIG. 5 is a sectional view taken along lines V—V of FIG. 3 and rotated 90° with respect to the view shown therein.

As seen from the drawings embodying this invention, as especially in FIGS. 3, 4 and 5 thereof, the shroud 30 according to the teachings of this invention comprises a first and second axial segment indicated in the drawings by reference numerals 30A and 30B. The shroud segments 30A and 30B are joined along a circumferential seam 34. Each shroud segment has, along its adjoining edge, openings 36A and 36B, respectively, which are sized in the appropriate configuration so as to engage the stem portion 24 of the tenon 22. The segments, as mentioned, may engage any predetermined number of tenons.

As best seen in the plan view shown in FIG. 3, openings 36A are sized to receive and engage the axially upstream surfaces of the parallelopiped stem 24 while the openings 36B are sized to engage the axially downstream surfaces of the stem 24. The snug engagement of the openings 36A and 36B with the stem 24 insures that the bulbous cap portion 26 simultaneously overlaps segments 30A and 30B both circumferentially and axially, the axial interface being shown in FIG. 5 by reference numerals 40A and 40B, respectively. The shroud segments also radially abut the surface 20 of the blade 12, as shown by reference numerals 41A and 41B. It may thus be appreciated that yielding a bulbous cap portion 26 to overlap the shroud segments 30A and 30B while those segments receive and snugly engage the stem 24 yielding an effective radial anchor to maintain the segmented shroud 30 in position above the group of subtended blades 12.

In practice, the method of fabrication of the rotor is as follows. After machining the stems 24 and the bulbous cap portions 26 of the tenons 22 on the extreme radial tip 18 of the blades 12 and providing corresponding openings 36A and 36B in the adjoining edges of the shroud segments 30A and 30B respectively, the shroud segments 30A and 30B are axially moved over the surface 20 of the tip 18 of the blades 16 until the stem 24 is engaged by the appropriate openings 36A and 36B on the shroud segments 30A and 30B, respectively. With this engagement intact, there occurs simultaneous axial and circumferential overlap between the bulbous cap portion 26 and the radially outward surface of the shroud segments 30A and 30B. Thus, the shroud segments 30A and 30B are secured radially to the subtended blade group.

In order to axially secure the shroud segments 30A and 30B, there is provided in each of them along their adjoining surfaces an inclined step or notch shown in FIG. 5 of the drawings as reference numerals 42A and 42B. The notches 42A and 42B, cooperate to define a circumferential groove 44 (FIG. 3) extending in that direction about the shroud 30. A suitable securing arrangement, such as weld 46, is provided in the groove 44 to axially maintain together the segments 30A and 30B of the shroud ring 30. Of course, other suitable axial attachment arrangements may be provided, the weld 46 being illustrative and not exhaustive thereof.

It may thus be appreciated that an effective, easy to install, turbine rotor arrangement is provided by the teachings of this invention. It may also be seen that the disadvantages attendant upon the construction utilized in the prior art are eliminated by providing the integral bulbous cap portion which provides the radially securing interface between the adjoining axial segments of the shroud 30. Of course, since the bulbous cap portion 26 is of greater cross section dimension than the stem 24, the radial insertion method utilized by the prior art to secure the shroud segments to their subtended blade group may not be advantageously utilized when employing the teachings of this invention. Thus, it is required that the shroud 30 be segmented into first and second axial segments 30A and 30B. Axial insertion of those last mentioned segments under the bulbous cap 26 to insure that the radial-securing interface 41A and 41B is generated and the axial securing of these segments completes the fabrication.

It is also well known to those skilled in the art that surface 20 on the tip 18 of the airfoil 16 may be inclined relative to an axis 48 extending through the rotor 10. The angle of the incline, commonly known as the blade tip angle 50, varies within a range of 0 to 30°. If such an inclined blade tip angle 50 is disposed within a particular turbine construction, it is to be understood that an axis 52 extending through the tenon 22 defines a right angle with the inclined radial blade surface 20. However, such an inclined blade tip disposition does not alter the fundamental teachings and fabrication requirements as hereinbefore disclosed.

What is claimed is:

1. An axial flow turbine comprising:

a casing a rotor shaft extending centrally and axially through said casing, a plurality of substantially radially extending rotating blades mounted on said rotor, each of said blades having an integral tenon member mounted thereon, said tenon comprising a stem portion and an integral bulbous cap portion, said stem portion having an upstream and a downstream surface thereon, a substantially annular shroud member subtending a predetermined number of said plurality of blades, said shroud member comprising a first and a second axial segment, said first axial segment having openings therein sized to accommodate said upstream surface of said stems of said tenons disposed on said blades subtended by said shroud, said second axial segment having openings therein sized to accommodate said downstream surface of said stems, said first and second segments disposed so that engagement of said first segment with said upstream surface of said tenon stem and engagement of said second segment with said downstream surface of said tenon stem causes said shroud segments to abut along a substantially circumferential interface and dispose the underside of said bulbous cap in simultaneously axially and circumferentially overlapping engagement with said abutted shroud, an inclined surface extending circumferentially about the axially downstream edge of said first shroud segment, an inclined surface extending circumferentially about the axially upstream edge of said second shroud segment, said inclined surfaces cooperating to define a groove extending circumferentially between the abutting shroud segments, and, a fastener disposed in said groove to firmly secure said first segment to said second segment.

2. The device of claim 1, wherein said tips of said blades are inclined with respect to said rotor's axis of rotation and said tenons extend perpendicularly from said tips.

3. A shroud for an axial flow turbine apparatus including a plurality of rotating blades mounted on a rotor, said blades terminating in a tip portion having a tenon extending therefrom, said tenon having a stem portion and a bulbous cap portion integral therewith, said shroud comprising a first circumferential segment having openings therein, a second circumferential segment having openings therein, and weld means for axially securing said first segment to said second segment, said openings in said segments disposed so that when said first and second segments are joined axially the openings register to define a space able to receive the stem portions of tenons, said shroud segments sized radially so that said shroud segments simultaneously radially abut the tip portion of said blades on the radially inward side of said shroud segments and radially abut said bulbous cap of said received tenon on the radially outward side of said shroud segments.

4. The shroud of claim 3 wherein each segment has a plurality of openings which, when joined, define a plurality of spaces, each space being able to receive one of a predetermined plurality of tenon stems on said blades.

5. The shroud of claim 3, wherein said first and second circumferential segments each have an inclined surface disposed along the axial joint therebetween, said inclined surfaces cooperating to define a groove within which said weld means is disposed.

6. A method for fabricating a turbine rotor comprising the steps of a. attaching rotating blades having an integral tenon which has a stem and bulbous cap portion to said rotor;

b. axially inserting a first and a second shroud segment over the tip of said blades until said segments abut circumferentially and said bulbous cap simultaneously axially and circumferentially overlaps said shroud segments, and c. metallurgically securing said first and second shroud segments axially together.

7. The method of claim 6, wherein said step *c* comprises the steps of a. providing an inclined surface along the abutting edges of the shroud segments to define a circumferential groove therein, and b. disposing securing means for axially securing said segments in said groove.

* * * * *